US011356781B2

(12) United States Patent
Zhang

(10) Patent No.: US 11,356,781 B2
(45) Date of Patent: Jun. 7, 2022

(54) SPEAKER UNIT AND SPEAKER DEVICE

(71) Applicants: Yongchun Zhang, Heilongjiang (CN); Shenzhen Xinqi Science and Technology Co., Ltd., Shenzhen (CN)

(72) Inventor: Yongchun Zhang, Heilongjiang (CN)

(73) Assignee: Shenzhen Xinqi Science and Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/266,421

(22) PCT Filed: Aug. 6, 2019

(86) PCT No.: PCT/CN2019/099457

§ 371 (c)(1),
(2) Date: Feb. 5, 2021

(87) PCT Pub. No.: WO2020/029962

PCT Pub. Date: Feb. 13, 2020

(65) Prior Publication Data

US 2021/0297785 A1 Sep. 23, 2021

(30) Foreign Application Priority Data

Aug. 7, 2018 (CN) ..... 201810888602.3

(51) Int. Cl.
*H04R 9/06* (2006.01)
*H04R 7/14* (2006.01)
(Continued)

(52) U.S. Cl.
CPC ..... *H04R 9/06* (2013.01); *H04R 7/122* (2013.01); *H04R 7/14* (2013.01); *H04R 9/022* (2013.01);
(Continued)

(58) Field of Classification Search
CPC ..... H04R 7/122; H04R 7/14; H04R 9/022; H04R 9/025; H04R 9/046; H04R 9/06;
(Continued)

(56) References Cited

U.S. PATENT DOCUMENTS 1,775,294 A * 9/1930 Poroma ..... H04R 7/14 181/164
1,917,013 A * 7/1933 Bostwick ..... H04R 7/12 181/164
(Continued)

FOREIGN PATENT DOCUMENTS

CN 1207011 A 2/1999
CN 101321410 A 12/2008
(Continued)

OTHER PUBLICATIONS

International Search Report dated Oct. 28, 2019 received in International Application No. PCT/CN2019/099457.
(Continued)

*Primary Examiner* — Huyen D Le
(74) *Attorney, Agent, or Firm* — Scully Scott Murphy & Presser

(57) ABSTRACT

Provided are a speaker unit and a speaker device. A main body of the speaker unit is a rectangular bowl-shaped structure, and comprises a suspension system, a magnetic circuit system having an annular magnetic gap, and a bowl-shaped frame connecting the suspension system and the magnetic circuit system. The bowl-shaped frame accommodates the suspension system and the magnetic circuit system. The magnetic circuit system is fixed to the interior of the bowl-shaped frame. The suspension system comprises a diaphragm and at least one voice coil connected to a bottom portion of the diaphragm. The magnetic circuit system comprises at least one magnetic circuit assembly matching the voice coil. One end of the voice coil is
(Continued)

connected to the diaphragm by means of a voice coil frame. The other end of the voice coil is suspended within an annular magnetic gap of the magnetic circuit assembly. The voice coil can perform piston-like reciprocating motion in an axial direction in the annular magnetic gap so as to push the diaphragm to vibrate and emit sound. The present invention employs multiple engines to drive the same diaphragm to vibrate, such that vibration is more uniform and stable, thereby reducing nonlinear vibration, and controlling a magnitude of resistance (RE). The invention has a wide range of applications and an attractive appearance, and realizes efficient heat dissipation.

14 Claims, 8 Drawing Sheets

(51) Int. Cl.
*H04R 9/02* (2006.01)
*H04R 9/04* (2006.01)
*H04R 7/12* (2006.01)

(52) U.S. Cl.
CPC ..... *H04R 9/025* (2013.01); *H04R 9/046* (2013.01); *H04R 2207/021* (2013.01); *H04R 2400/11* (2013.01)

(58) Field of Classification Search
CPC ..... H04R 2207/00; H04R 2207/021; H04R 2400/11
See application file for complete search history.

(56) References Cited

U.S. PATENT DOCUMENTS

| | | | | |
|---|---|---|---|---|
| 4,122,314 | A | 10/1978 | Matsuda et al. | |
| 5,841,880 | A | 11/1998 | Sakamoto | |
| 5,880,412 | A * | 3/1999 | Faraone | H04R 7/14 181/173 |
| 9,544,693 | B2 | 1/2017 | Deffarges | |
| 2008/0025549 | A1* | 1/2008 | Avera | H04R 9/022 381/397 |
| 2013/0051604 | A1 | 2/2013 | Sakai | |
| 2013/0108099 | A1* | 5/2013 | Kemmerer | H04R 9/022 381/397 |
| 2018/0213330 | A1 | 7/2018 | Hou | |

FOREIGN PATENT DOCUMENTS

| | | | |
|---|---|---|---|
| CN | 202395977 | U | 8/2012 |
| CN | 204559868 | U | 8/2015 |
| CN | 106412774 | A | 2/2017 |
| CN | 108966095 | A | 12/2018 |
| CN | 109195076 | A | 1/2019 |
| DE | 202007009856 | U1 | 9/2007 |
| EP | 2114087 | A1 | 11/2009 |
| KR | 101173392 | B1 | 8/2012 |

OTHER PUBLICATIONS

Extended European Search Report dated Aug. 27, 2021 received in European Patent Application No. EP 19847873.7.

* cited by examiner

SPEAKER UNIT AND SPEAKER DEVICE

TECHNICAL FIELD

The present disclosure relates to the technical field of dynamic loudspeakers, in particular to a loudspeaker unit and a loudspeaker device.

BACKGROUND

As a key component of audio equipment, the quality of a loudspeaker unit directly affects the realization of the effect of sound quality of the audio equipment. So far, the shape and structure of various components of traditional loudspeaker units (especially mid-woofer loudspeaker units) are each circular. For example, most of the membranes are conical membranes. The effective area of vibration of the conical membrane is small, and the efficiency of sound energy conversion is poor. At the same time, the circular membrane will produce radial and axial split vibrations during movement, which in turn generates a lot of interfering harmonics to form harmonic distortion. In addition, most of the existing loudspeakers are driven by a single engine and adopt an external magnet structure, and the voice coil is prone to nonlinear deviation during the movement, thus causing various distortion problems such as harmonic distortion and phase distortion. In addition, the existing loudspeakers have poor heat dissipation effect, which may cause the voice coil to be degummed, short-circuited or destroyed, or cause deformation of the membrane, a spider, etc., which will affect the performance of the loudspeaker.

In addition, as shown in FIG. 1, a linear sound source formed by the traditional professional line array is generally produced by a conical loudspeaker or at least the bass is produced by a conical loudspeaker. The linear sound source is a substantial line array containing spherical waves, rather than a pure line array formed by cylindrical waves. A boundary curve $l_2$ of the spherical waves on both sides of the array line $l_1$ is exponentially changing gradually. An intersection area S of adjacent wavefronts in the spherical waves radiated between multiple voice boxes exhibits an exponential gradual change in four directions. After multiple wavefronts form an array, the intersection area cannot be weakened, that is, multiple spherical waves cannot be coupled in an organized manner. It is easy to form a chaotic sound field, cause interference, and affect the effective coverage of sound.

SUMMARY

An object of the present disclosure is to at least solve one of the above-mentioned defects and shortcomings, and the object is achieved through the following technical solutions.

The present disclosure provides a loudspeaker unit, wherein a main body of the loudspeaker unit is of a rectangular basin-like structure including a suspension system, a magnetic circuit system with a ring-like magnetic gap, and a basket connecting the suspension system with the magnetic circuit system; the basket accommodates the suspension system and the magnetic circuit system, the magnetic circuit system is fixed in the basket, the suspension system includes a membrane and at least one voice coil connected to a bottom of the membrane, and the magnetic circuit system includes at least one magnetic circuit assembly that matches the voice coil, wherein one end of the voice coil is connected to the membrane through a voice coil bobbin, and the other end of the voice coil is suspended in the ring-like magnetic gap formed by the magnetic circuit assembly; and the voice coil can vibrate reciprocatively like a piston in an axial direction in the ring-like magnetic gap to push the membrane to vibrate and emit a sound.

Further, the suspension system further includes a spider and a corrugated rim, and the membrane includes a membrane bottom, a membrane body, and a membrane edge that are sequentially connected from the inside to the outside, wherein the membrane bottom is fixed to the basket through the spider sleeved over the outside of the voice coil bobbin, the membrane edge is connected to an edge of the basket through the corrugated rim, and the membrane bottom is connected to the membrane edge through the membrane body; the membrane body is configured as a three-dimensional array structure composed of a plurality of irregular-face bodies, the three-dimensional array structure is distributed throughout the surface of the membrane body, and adjacent irregular-face bodies are connected to each other through edges thereof.

Further, the membrane further includes a membrane base arranged at the membrane bottom, the membrane base is bonded to a back side of the membrane bottom, the membrane is fixedly connected to the basket through the membrane base, and the membrane base is provided with a voice coil connection portion connected with the voice coil bobbin.

Further, the voice coil is wound on the periphery of one end of the voice coil bobbin, and the other end of the voice coil bobbin is connected to the membrane base through the voice coil connection portion.

Further, the irregular-face bodies are triangular-face bodies, and the shapes and sizes of a plurality of the triangular-face bodies are each not exactly the same.

Further, the magnetic circuit assembly includes a magnetic cup, a magnet, and a magnetic conduction plate, wherein the magnetic cup is installed at a bottom of the basket, the magnet and the magnetic conduction plate are located in the magnetic cup, one end of the magnet is attached to a bottom of the magnetic cup, and the other end of the magnet is attached to the magnetic conduction plate; the ring-like magnetic gap is formed between the magnetic cup and the magnet and the magnetic conduction plate, and the voice coil is located in the ring-like magnetic gap.

Further, a plurality of the voice coils and a plurality of the magnetic circuit assemblies are provided, the cross-sectional shapes of the voice coils and the magnetic circuit assemblies are both rectangular, and the ring-like magnetic gap is a rectangular ring-like magnetic gap.

Further, the plurality of voice coils are connected to each other through a circuit, and the circuit includes a series-connection circuit, a parallel-connection circuit, or a series-parallel comprehensive circuit.

Further, the bottom of the membrane is provided with a circuit board for supplying current to the voice coils, and the plurality of voice coils are respectively connected to the circuit board through lead wires.

Further, the voice coil is formed by winding a strip-like monolithic body, and the monolithic body includes a printed flexible circuit board or a single-side insulated metal foil strip.

Further, the voice coil bobbin is made of a high temperature resistant material which includes a high temperature resistant injection molding material or a lightweight ceramic material, and the voice coil bobbin is of an integral structure.

Further, the spider is of a rectangular ring-like structure, and the spider includes a base layer, a flexible outer ring and a rigid inner ring, wherein the outer ring is arranged on a side of the base layer that is close to the basket, the inner ring is arranged on a side of the base layer that is close to the voice coil, and the base layer, the outer ring and the inner ring are integrally formed by laminated pressing.

Further, the corrugated rim is of a rectangular ring-like structure, the cross-sectional shape of the corrugated rim is a corrugated shape, the corrugated shape includes at least one peak and at least one valley, and the shapes of different peaks and valleys are not exactly the same; the corrugated rim is provided with a plurality of reinforcement ribs for reinforcing the corrugated rim, and the adjacent reinforcement ribs are separated by a certain distance.

Further, the basket is of an integral structure, edges of the basket are in circular arc transition, a side face of the basket is provided with a gradually changing support mechanism, and the bottom of the basket is provided with a ventilation mechanism.

The present disclosure also provides a loudspeaker device including at least one loudspeaker unit described above.

Further, a plurality of the loudspeaker devices form a linear array voice box system.

The present disclosure has the following advantages:

(1) In the present disclosure, the loudspeaker unit is arranged to have a rectangular rounded-corner structure, which optimizes the structure of the loudspeaker, and the edges of the loudspeaker have a smooth curve or curved surface transition, which is beautiful, practical and elegant.

(2) The present disclosure adopts a membrane with a rectangular basin-like structure, and the membrane body is configured as a three-dimensional geometric structure composed of irregular triangular-face bodies, which not only increases the rigidity modulus and self-damping of the membrane, but also increases air disturbance, and improves the conversion of audio; in addition, the rectangular basin-like structure of the membrane not only reduces mechanical distortion loss and group delay, but also reduces split vibration, nonlinear movement, acoustic focusing and front chamber effect.

(3) In the loudspeaker unit of the present disclosure, multiple engines coordinate with each other to jointly drive the membrane to vibrate, so that the movement of the loudspeaker tends to be more linear, thereby reducing nonlinear distortion, and making the movement more balanced and stable; the impedance $R_E$ and reactance $L_{VC}$ can be controlled through a variety of freely connected voice coil circuits, and then $Q_{ES}$, $Q_{MS}$ and $Q_{TS}$ can be reasonably controlled, which can effectively reduce power consumption, improve loudspeaker efficiency, and also reduce resonant frequency $f_s$; multiple engine assemblies coordinate with each other and restrict each other, which can reduce various distortions and improve the acoustic performance of the loudspeaker; in addition, a size range of the loudspeaker unit such as caliber is also expanded, and the scope of application of the loudspeaker is expanded.

(4) The present disclosure improves the acoustic performance of the loudspeaker and improves the heat dissipation effect of the voice coils by changing the structures of the voice coils and the voice coil bobbin to reduce the nonlinearity of the piston-like movement. At the same time, the heat is dissipated through the flow diversion and ventilation of the magnetic circuit, and the basket of the loudspeaker is designed for heat dissipation to enhance air circulation and realize sufficient heat dissipation.

(5) The basket of the present disclosure can reduce the mass and cost of the product while meeting the rigidity requirements and installation size requirements for supporting, effectively reduce various resonances that the basket may produce, and improve the sound quality of the loudspeaker.

(6) The present disclosure adopts the spider formed by laminated pressing of a variety of materials, which can effectively improve the radial high rigidity of the inner ring of the spider and the axial high compliance of the outer ring, thereby reducing the nonlinear deviation of the voice coil and increasing the restoring force of the suspension system, and making it easy to vibrate greatly and increasing the kinetic energy of the suspension system to achieve high axial compliance; moreover, the resonant frequency can be effectively reduced, thereby improving the sound quality of the loudspeaker.

(7) The present disclosure can effectively improve the radial rigidity of the corrugated rim, while reducing the harmonic resonance, thereby reducing the auxiliary membrane effect of the corrugated rim, and improving the sound quality of the loudspeaker; the corrugated rim is also provided with reinforcement ribs to reinforce radial rigidity and increases the toughness, fatigue strength and service life of the corrugated rim, while also effectively suppressing resonance and harmonics.

BRIEF DESCRIPTION OF THE DRAWINGS

Upon reading a detailed description of preferred embodiments below, various other advantages and benefits will become clear to those skilled in the art. The drawings are only used for the purpose of illustrating the preferred embodiments, and should not be considered as limiting the present disclosure. Throughout the drawings, identical parts are denoted by identical reference signs.

REFERENCE SIGNS

Figure 1:
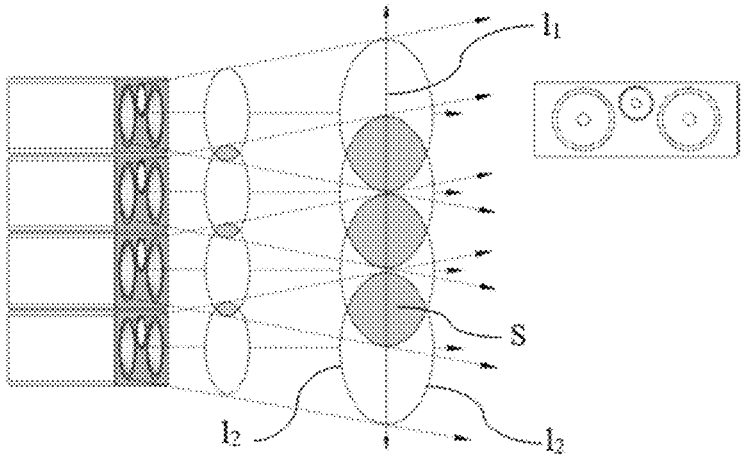
FIG. 1 is a schematic view of a line array system composed of spherical wave loudspeakers.

100: loudspeaker unit; 10: basket;
11: base; 12: first mounting seat;
13: second mounting seat; 14: first support mechanism;
15: second support mechanism; 111: ventilation duct;
112: ventilation hole; 113: heat sink;
20: membrane; 21: membrane bottom;
22: membrane body; 221: triangular-face body;
23: membrane edge; 24: membrane base;
241: circuit board; 31: voice coil;
32: voice coil bobbin; 311: first voice coil;
312: second voice coil; 313: third voice coil;
314: fourth voice coil; 321: heat dissipation hole;
40: magnetic circuit assembly; 41: magnetic cup;
42: magnet; 43: magnetic conduction plate;
44: magnetic gap; 50: spider;
51: base layer; 52: outer ring;
53: inner ring; 541: first corrugation;
542: second corrugation; 543: third corrugation;
60: corrugated rim; 61: reinforcement rib;
70: dust cap; 200: loudspeaker device.

DETAILED DESCRIPTION

Hereinafter, exemplary embodiments of the present disclosure will be described in more detail with reference to the accompanying drawings. Although exemplary embodiments of the present disclosure are shown in the drawings, it should be understood that the present disclosure may be implemented in various forms and should not be limited by the embodiments set forth herein. On the contrary, these embodiments are provided to enable a more thorough understanding of the present disclosure and to fully convey the scope of the present disclosure to those skilled in the art.

FIGS. 2 to 6 show schematic structural views of a loudspeaker unit provided by an embodiment of the present disclosure. As shown in FIGS. 2 to 6, a main body structure of the loudspeaker unit 100 provided by the present disclosure is a rectangular basin-like structure including a suspension system, a magnetic circuit system with a rectangular ring-like magnetic gap, and a basket 10 connecting the suspension system with the magnetic circuit system; the basket 10 accommodates the suspension system and the magnetic circuit system, the magnetic circuit system is fixed in the basket 10, the suspension system includes a membrane 20, a spider 50, a corrugated rim 60 and at least one voice coil 31 for driving the membrane 20, and the magnetic circuit system includes at least one magnetic circuit assembly 40 that matches the voice coil 31 and provides a magnetic field for the movement of the voice coil 31, wherein one end of the voice coil 31 is fixedly connected to a bottom of the membrane 20 through a voice coil bobbin 32, and the other end of the voice coil 31 is suspended in a magnetic gap 44 formed by the magnetic circuit assembly 40; after being energized, the voice coil 31 can vibrate reciprocatively like a piston in an axial direction in the magnetic gap 44 to push the membrane 20 to vibrate, thereby pushing air to generate sound waves and emit a sound.

The membrane 20 is of an integral structure, including a membrane bottom 21, a membrane body 22, and a membrane edge 23 that are sequentially connected from the inside to the outside; the membrane bottom 21 is fixed to the basket 10 through the spider 50 sleeved over the outside of the voice coil bobbin 32, the membrane edge 23 is connected with an edge of the basket 10 through the corrugated rim 60, and the membrane bottom 21 is connected to the membrane edge 23 through the membrane body 22; the membrane body 22 is configured as a three-dimensional array structure composed of a plurality of irregular-face bodies, the three-dimensional array structure is distributed throughout the surface (including both front and back faces) of the membrane body 22, and the adjacent irregular-face bodies are connected to each other by edges thereof. In this embodiment, the irregular-face bodies are triangular-face bodies, and the shapes and sizes of the plurality of triangular-face bodies are each not exactly the same. The stability of the three-dimensional array structure composed of the irregular-face bodies can ensure a stable support of the membrane 20, increase the rigidity modulus of the membrane 20, and reduce the mechanical distortion loss and split vibration of the membrane 20.

Specifically, taking triangular-face bodies 221 as an example, the edges of the triangular-face bodies 221 and edges shared by adjacent triangles constitute a skeleton of the membrane 20, and the skeleton has a large rigidity modulus and can play a stable supporting role; at the same time, the triangular geometric body itself has a stabile structure. In addition, the triangular geometric bodies are in different planes, and there is no plane that is prone to producing split vibration, so that the membrane 20 is not prone to producing split vibration, thereby reducing harmonic distortion; since different triangular-face bodies 221 have different structures, and different triangular-face bodies are distributed on the surface of the membrane body 22 in a staggered manner, the lines and the surfaces restrict each other, and it is impossible to produce split vibration.

Figure 7:
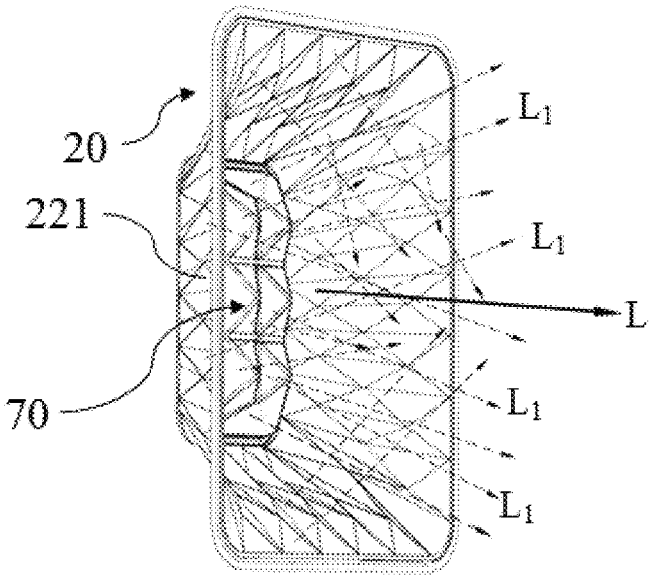
FIG. 7 is a schematic view showing sound wave diffusion when a membrane of the loudspeaker unit provided by the embodiment of the present disclosure vibrates.

FIG. 7 shows a schematic view of sound wave radiation of the membrane provided by the embodiment of the present disclosure. In the figure, a solid-line arrow L represents a central axis direction of the membrane 20 of the loudspeaker, and dashed-line arrows $L_1$ represent sound wave radiation directions perpendicular to face bodies. Due to the overall rectangular basin-like structure of the membrane 20 of the loudspeaker, the distances from the central axis L of the membrane 20 of the loudspeaker to the surrounding peripheries are unequal, so it is impossible to form a gathering area. At the same time, the plurality of triangular-face bodies 221 that are not located in the same plane make the sound wave radiation directions $L_1$ perpendicular to the triangular-face bodies 221 different from each other, which can increase the diffusion and reduce the front chamber effect, thereby reducing the phase distortion.

In addition, a formula $V_D=S_D\times X_{Max}$ is used, where $V_D$ is an air displacement, $S_D$ is a developed area of the membrane 20, and $X_{Max}$ is the maximum linear displacement of the voice coil in the magnetic gap. Since the membrane body 22 has a three-dimensional array structure, the developed area of the membrane 20 is increased. Air particles disturbed by the membrane 20, that is, the air displacement, increase randomly, thereby increasing the converted sound energy and improving the conversion rate of audio.

A dust cap 70 is provided at the center of the front face of the membrane bottom 21. The dust cap 70 is bonded to the center of the membrane 20 to prevent dust from entering the magnetic gap 44 to affect the audio performance; at the same time, the dust cap 70 can play a positive role of diffusion to reduce the collision of air particles containing sound waves and reduce the phase distortion and harmonic distortion caused by the collision.

In a specific implementation, the material used for the membrane 20 is mainly paper pulp, with a certain proportion of carbon fiber and wool added to modify the paper pulp, thereby prolonging its service life, fatigue resistance and self-damping.

Figure 8:
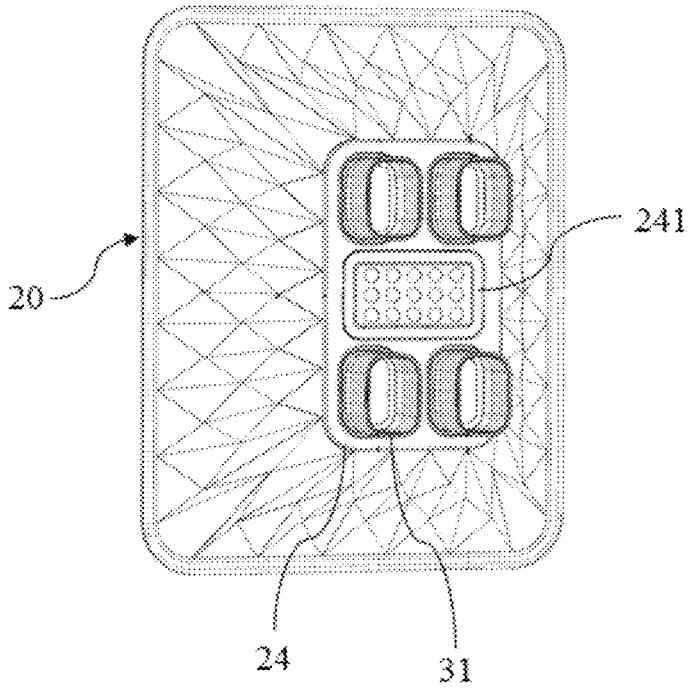
FIG. 8 is a schematic view of assembling the membrane and voice coils of the loudspeaker unit provided by the embodiment of the present disclosure.

As shown in FIG. 8, since the bottom of the membrane 20 of the loudspeaker is of a planar structure without triangular rigid support, in order to make it difficult for the membrane 20 to deform when assembling the membrane 20 with the basket 10, a membrane base 24 is provided at the membrane bottom 21. The membrane base 24 has a certain rigidity. The membrane base 24 is provided with an installation interface connected with the voice coil bobbin 32. The membrane 20 and the voice coil bobbin 32 can be quickly positioned through the membrane base 24, and can be assembled to the bottom of the basket 10 through the spider 50, thereby reducing the assembly difficulty of the membrane 20, the voice coil bobbin 32 and the spider 50, and further reducing the assembly man-hours and manufacturing cost of the entire loudspeaker. A circuit board 241 is also provided at the center of the membrane base 24 for connecting with the voice coils 31 and providing an external current to the voice coils 31.

The voice coils 31 and the magnetic circuit assembly 40 constitute an engine system of the loudspeaker unit 100, which can provide power for the vibration of the membrane 20. The numbers of the voice coils 31 and the magnetic circuit assemblies 40 may be set according to the caliber size of the loudspeaker unit 100. Either a single-engine system or a multi-engine system may be used. The single-engine system is configured as a single-engine assembly composed of one voice coil 31 and one magnetic circuit assembly 40, and the multi-engine system is configured as a combined array of multiple single-engine assemblies composed of multiple voice coils 31 and multiple magnetic circuit assemblies 40. The multiple voice coils 31 and multiple magnetic circuit assemblies 40 cooperate to form a multi-engine system to jointly drive the same membrane 20 to vibrate. In this embodiment, the loudspeaker unit 100 is provided with four voice coils 31 and four magnetic circuit assemblies 40. Different voice coils 31 are connected through circuits.

In order to match the shapes of the rectangular basket 10 and the membrane 20, and to ensure that the magnetic gap 44 of the magnetic circuit system is of a rectangular ring-like structure, the cross-sectional shapes of the voice coils 31 and the magnetic circuit assemblies 40 are each set to be rectangular, and the rectangular shape includes an oblong shape or a square shape, with the four sides of the rectangle in rounded corner transition. By adopting the rounded corner transition, the collision of the voice coils 31 in the magnetic gap can be reduced, and the damage to the voice coils 31 can be reduced.

Figure 9:
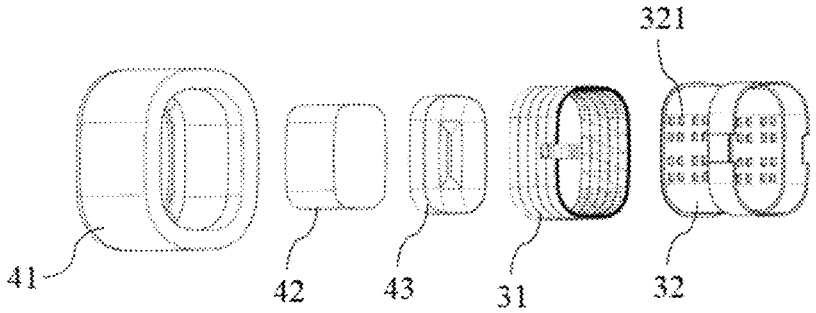
FIG. 9 is a schematic structural view of an engine system of the loudspeaker unit provided by the embodiment of the present disclosure.

As shown in FIG. 9, taking a single-engine system as an example, the structures of the voice coils 31 and the magnetic circuit assemblies 40 will be described in detail. In a preferred implementation, the voice coil 31 is formed by winding a printed flexible circuit board (FPC) or a single-side insulated metal foil strip. Specifically, the printed flexible circuit board (FPC) or the metal foil strip each has a strip-like monolithic structure. The strip-like sheet is wound on the rectangular sleeve-like voice coil bobbin 32 to form the rectangular ring-like voice coil 31, and the voice coil 31 is connected to the bottom of the membrane 20 through the voice coil bobbin 32. When the printed flexible circuit board (FPC) is used, the flexible circuit board includes a conductive layer and an insulating layer. During the winding, one side of the insulating layer closely abuts the voice coil bobbin 32. In a specific implementation, the flexible circuit board may be provided with multiple longitudinal conductive layers (5 in this embodiment), and the multiple conductive layers are adhered to the insulating layer, and arranged tightly to wind around the periphery of the voice coil bobbin 32 to form the rectangular ring-like voice coil 31. When the metal foil strip is used, the insulating side of the metal foil strip closely abuts the voice coil bobbin 32. Since the voice coil 31 is formed by winding a thin strip-like sheet, the heat dissipation area is large, which can greatly improve the heat dissipation effect of the voice coil 31 and reduce the damage to the voice coil 31. In addition, the thin strip-like sheet can be wound on the voice coil bobbin 32 by multiple turns to increase the length of the voice coil. According to a formula F=BLI, the ampere force (driving force) of the voice coil 31 increases, which can improve the sound conversion efficiency, where B is the average magnetic flux density inside the voice coil, L is the length of voice coil, and I is the current. The thickness of the voice coil 31 after winding (the wound and laminated thickness of the strip-like sheet) is 0.6 mm to 1.2 mm.

The voice coil 31 is provided with a lead wire, wherein one end of the lead wire is fixedly connected to the voice coil 31, and the other end of the lead wire is a free end which is connected to the circuit board 241 provided on the membrane base 24 to access external current. The lead wire is used as a signal input terminal of the voice coil 31 and is generally a metal conductor. The lead wire is drawn out from an end face of one end of the voice coil 31, which can reduce the phenomenon such as loose wire and wire disconnection of the voice coil 31 during vibration, prolong the service life of the lead wire, and ensure the quality of the voice coil.

The voice coil bobbin 32 is made of a high-temperature resistant material and is integrally processed and formed. For example, high-temperature resistant injection molding materials or lightweight ceramic materials such as silicon nitride ($Si_3N_4$) and silicon carbide (SiC) can be used. These materials are light in weight and have good rigidity and good heat dissipation effect, and can realize the precise positioning of the voice coil 11 and reduce the error rate during assembly. The greater the number of voice coils is, the more complicated the requirements for accurate positioning and the higher the accuracy requirements will be. Once the arrangement and position layout of the multiple voice coils 31 at the membrane bottom 20 are determined, the mapping (projection) position of the engine system at the bottom of the basket 10 is determined, and an accurate assembling of the loudspeaker unit 100 is realized. The precise positioning of the voice coils 31 can reduce the uneven distribution of magnetic force, reduce the damage to the voice coils 31 caused by collision with the magnetic circuit, and reduce the nonlinear movement of the voice coils 31. In addition, a plurality of heat dissipation holes 321 distributed in an array are provided on a side wall of the voice coil bobbin 32, which can dissipate the heat generated by the voice coils 31 timely while also reducing the mass of the voice coil bobbin 32.

The magnetic circuit assembly 40 includes a magnetic cup 41, a magnet 42 and a magnetic conduction plate 43. The magnetic cup 41 is installed at the bottom of the basket 10, the magnet 42 and the magnetic conduction plate 43 are arranged in the magnetic cup 41, and the magnetic conduction plate 43 is fixed to an end face of one end of the magnet 42. The magnetic gap 44 is formed between the magnetic cup 41 and the magnetic conduction plate 43, and the voice coils 31 are suspended in the magnetic gap 44. In order to ensure that the heat generated by the voice coils 31 can be dissipated timely, a plurality of heat dissipation holes are provided at the bottom of the magnetic cup 41.

Figure 10:
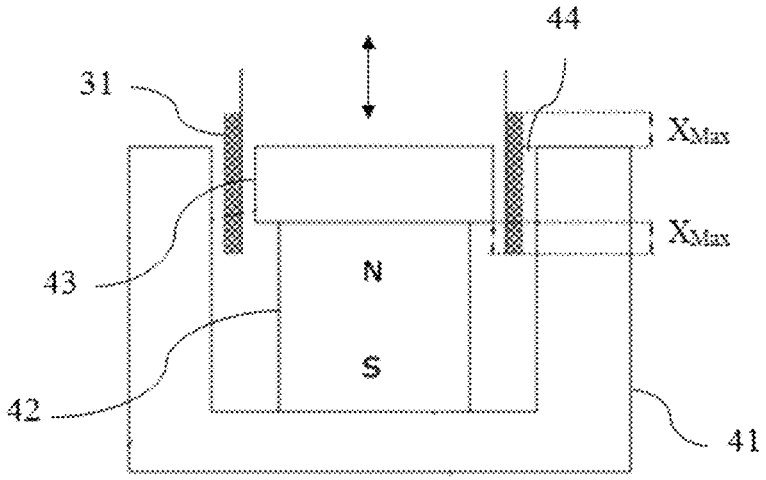
FIG. 10 is a schematic view of the operation of the engine system of the loudspeaker unit provided by the embodiment of the present disclosure.

Specifically, as shown in FIG. 10, the magnetic circuit assembly 40 is of an internal magnet structure. As compared with an external magnet structure, the internal magnet structure has a small volume, occupies a small space, and can reduce magnetic leakage. One end of the magnet 42 is attached to a bottom of the magnetic cup 41, and the other end of the magnet 42 is attached to the magnetic conduction plate 43. The ring-like magnetic gap 44 is formed between the magnetic cup 41 and the magnet 42 and the magnetic conduction plate 43, and the voice coils 11 are suspended in the magnetic gap 44. When the current is applied, the voice coil 31 vibrates reciprocatively in the magnetic gap 44 in an axial direction of the magnet 42 and the magnetic conduction plate 43 (the directions of the double-headed arrow in the figure are the vibration directions of the voice coils 11). The maximum linear displacement of the voice coil 11 in the magnetic gap 44 is $X_{Max}$. $X_{Max}$ is equal to a value obtained by dividing the difference between the height of the voice coil and the height of the magnetic gap by 2, and the value represents the range of movement of the movable part in one direction. Approaching or exceeding this range will cause nonlinear movement and generate harmonic distortion.

The magnet 42 is a strong neodymium-iron-boron magnet, which can provide a stronger magnetic field and provide greater power for the movement of the voice coil 11; in addition, the magnet 42 may also be made of other permanent magnet materials. The axial height of the magnetic gap 44 in the magnetic circuit system ranges from 4 mm to 8 mm, and the radial width of the magnetic gap 44 is 2 mm to 3 mm.

Configuring the magnetic circuit assembly 40 as a rectangular structure can increase the size of the magnet 42 in the vertical direction, provide a stronger magnetic field for the magnetic circuit system, and meanwhile increase the maximum linear displacement $X_{Max}$ of the voice coil 31 in the magnetic gap. According to the formula $V_D=S_D\times X_{Max}$, air particles disturbed by the membrane 20 can be increased, and the audio conversion can be increased. In addition, the four corners of the magnetic circuit assembly 40 of the rectangular structure are rounded, which can avoid rigid collision of the voice coil 31 in the magnetic circuit. In a specific implementation, the cross-sectional shapes of the voice coil 31 and the magnetic circuit assembly 40 may also be other shapes such as a circle or an ellipse, to which the present disclosure does not impose any specific restrictions.

When a single-engine system is used, the installation position of the voice coil 31 is set at the center of the membrane 20 to ensure the uniformity of vibration. When a multi-engine system is used, multiple voice coils 31 are arranged evenly in an array at the bottom of the membrane 20. In this embodiment, a four-engine system is adopted, wherein four voice coils 31 are arranged up and down and left and right at the bottom of the membrane 20. As compared with a single-engine loudspeaker, the use of a multi-engine system allows the size of a single engine assembly to be designed smaller. For loudspeaker units 100 of different caliber sizes and powers, it is only necessary to increase or decrease the number of engine assemblies according to the size of the loudspeaker unit 100, thus having a wide range of application. In a multi-engine system, different voice coils 31 of multiple engine assemblies are connected to each other through circuits. The circuit connection includes a separate series-connection circuit, a separate parallel-connection circuit, and a comprehensive circuit combining series and parallel connections. Different circuit connections can achieve an ideal impedance $R_E$.

Figure 11:
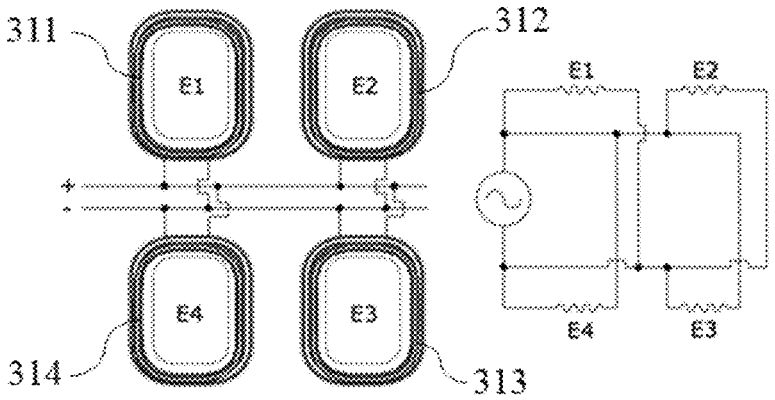
FIG. 11 is a schematic view showing circuit connection of the voice coils of the loudspeaker unit provided by the embodiment of the present disclosure.

FIG. 11 is a view showing circuit connection of a four-engine system according to the embodiment of the present disclosure. It is assumed that the $R_E$ of each voice coil 31 in this embodiment is 8Ω. Through the separate series-connection mode, the impedance that can be obtained by the four voice coils 31 is $R_E=R_{E1}+R_{E2}+R_{E3}+R_{E4}=32\Omega$; through the separate parallel-connection mode, the impedance that can be obtained by the four voice coils 31 is $R_E=1/(1/R_{E1}+1/R_{E2}+1/R_{E3}+1/R_{E4})=2\Omega$; and as shown in FIG. 9, through the comprehensive mode combining series and parallel connections, in which a first voice coil 311 and a fourth voice coil 314 are first connected in series up and down, a second voice coil 312 and a third voice coil 313 are connected in series up and down, and then the two groups of voice coils connected in series up and down respectively are connected in parallel left and right, the impedance that can be finally obtained is $R_E=8\Omega$. It can be seen from the above that the four voice coils 31, each of which has the $R_E$ of 8Ω, can be connected in parallel to obtain a smaller impedance of $R_E$ of 2Ω, which increases the current input to the voice coils 31 and improves the power of the voice coils 31. With the increase of engine assemblies, the circuit connection mode of the voice coils 31 also becomes more complicated, and the adjustment range of the impedance $R_E$ also becomes larger, so that the impedance $R_E$ of the loudspeaker unit 100 is controllable. The present disclosure can change the current in the voice coils 31 by directly changing the circuit connection mode, without adding an additional transformer to match the impedance and without relying on a high-power amplifier, which not only reduces the power consumption, but also reduces the power distortion caused by excessive power, and improves the efficiency $\eta_o$ of the loudspeaker.

In addition, according to a formula $Q_{TS}=(Q_{EX}\times Q_{MS})\div(Q_{ES}+Q_{MS})$, it can be known that the change of any one of parameters $Q_{ES}$ and $Q_{MS}$ will affect $Q_{TS}$. The lower the $Q_{ES}$ is, i.e., the smaller the electrical damping is, the higher the output power $N_o$ and the efficiency $\eta_o$ will be. In a case where $Q_{TS}$ is unchanged, effectively reducing the parameter value of $Q_{ES}$ will increase the parameter value of $Q_{MS}$. $Q_{ES}$ refers to the electrical Q value at the resonant frequency of the loudspeaker unit, that is, a ratio of the DC resistance $R_E$ of the voice coil to the motional impedance at the resonant frequency fs. $Q_{MS}$ refers to the mechanical Q value at the resonant frequency of the loudspeaker unit, that is, a ratio of the equivalent resistance of the mechanical loss impedance $R_{MS}$ of the unit support system to the motional impedance at the resonant frequency fs. $Q_{MS}$ indicates the mass of the voice coil 31 itself and the mechanical resistance $R_{MS}$ of the suspension system (including the voice coils 31, the membrane 20, the spider 50 and a suspended part of the corrugated rim 60). $Q_{TS}$ refers to the total Q value at the resonant frequency of the loudspeaker unit, that is, the parallel value of $Q_{ES}$ and $Q_{MS}$.

When the value of $Q_{MS}$ increases, the mass of the suspension system becomes greater, that is, the mass of the membrane in the suspension system is allowed to be greater; if the unit mass is converted into a unit area, it can be seen that the area of the membrane becomes larger. The increase in the mass and area of the membrane 20 results in more air particles disturbed, resulting in a lower resonant frequency fs. Therefore, as the number of engine assemblies increases, by reasonably controlling the impedance $R_E$ and the reactance $L_{VC}$ to further affect $Q_{ES}$, $Q_{MS}$ and $Q_{TS}$, the resonant frequency fs can be reduced more and the acoustic performance can be improved.

In a single-engine system, the voice coil 31 is located at the center of the membrane 20, and the membrane 20 is displaced forward and backward by the perpendicular push of the voice coils 31. Therefore, the larger the distance from the voice coils 31 to the membrane edge 23 (including the suspended part of the corrugated rim 60) is, the smaller the force directly and perpendicularly exerted by the voice coils 31 will be, and the greater the resulting mechanical distortion and loss will be. In a multi-engine system, as the number of voice coils 31 increases, the arrangement of voice coils 31 expands more toward the edge, and the distances between the voice coils 31 and the membrane edge 23 will decrease, which will reduce mechanical distortion loss and group delay. The reduction of mechanical distortion loss and group delay makes the maximum displacement $X_{Max}$ of the voice coils 31 in the magnetic gap 44 maintain greater linearity, and reduces the caused nonlinear movement and harmonic distortion, so that the vibration of the membrane 20 is more linear within a certain vibration range, which improves the acoustic performance of the loudspeaker unit 100.

In the multi-engine system, multiple engine assemblies work jointly to drive the same membrane 20 to vibrate, and at the same time, the multiple engine assemblies restrict each other, so that the distortion frequency of the loudspeaker unit 100 is greatly reduced. After receiving the same audio signal at the same time, all the voice coils 31 will perform linear piston-like movement at the same time to push the membrane 20 closely connected thereto to generate a series of complicated vibrations. The multi-engine system cooperates with the membrane 20 to perform high-power resolution on the audio signal and in-depth restoration of dynamic details, and the spatial array distribution of the multiple engine assemblies enables complete diffusion of sound. According to the principle of Fourier transform, the audio signals of the same channel are separated and superimposed for multiple times in fluctuation mode of frequency domain and time domain according to the principle of Fourier transform, and finally the electrical-force-acoustic conversion process is completed. The total sum of the cooperative work of multiple traditional single-engine loudspeakers is equivalently obtained. That is, the complete fluctuating state completed by multiple engines together can be expressed by the formula: $\Sigma E=E_1+E_2+\ldots+E_n$ or $\Sigma E=E\times n$, where $\Sigma E$ is the sum of all the engines of the loudspeaker, E is a single engine assembly, and n is the number of engine assemblies.

Figure 3:
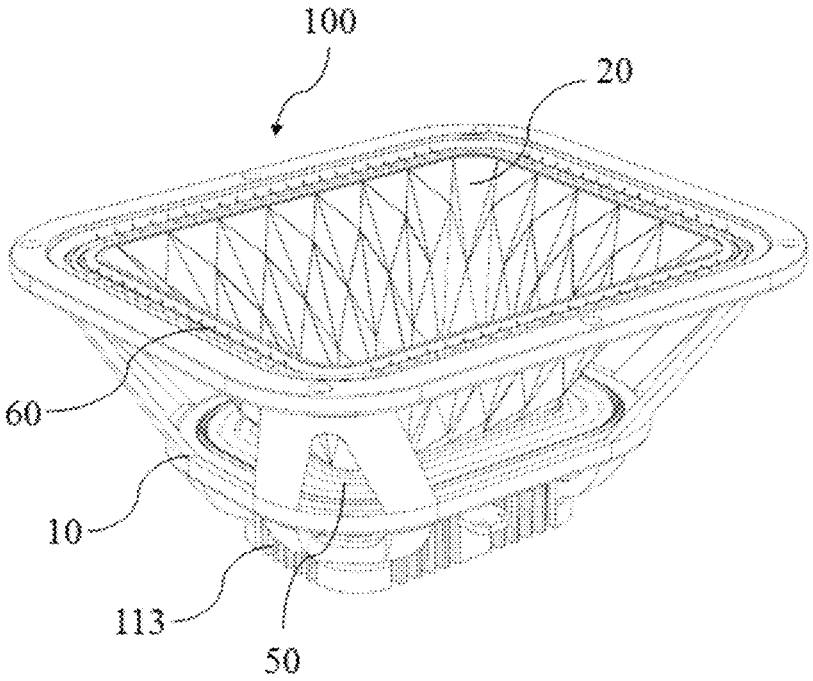
FIG. 3 is a schematic view of the three-dimensional structure of the loudspeaker unit provided by the embodiment of the present disclosure.
Figure 4:
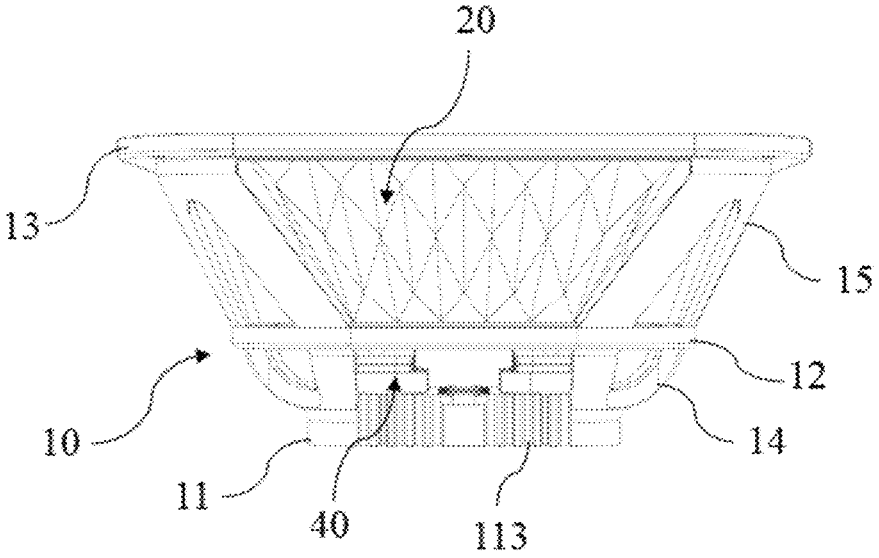
FIG. 4 is a side view of the loudspeaker unit provided by the embodiment of the present disclosure.
Figure 5:
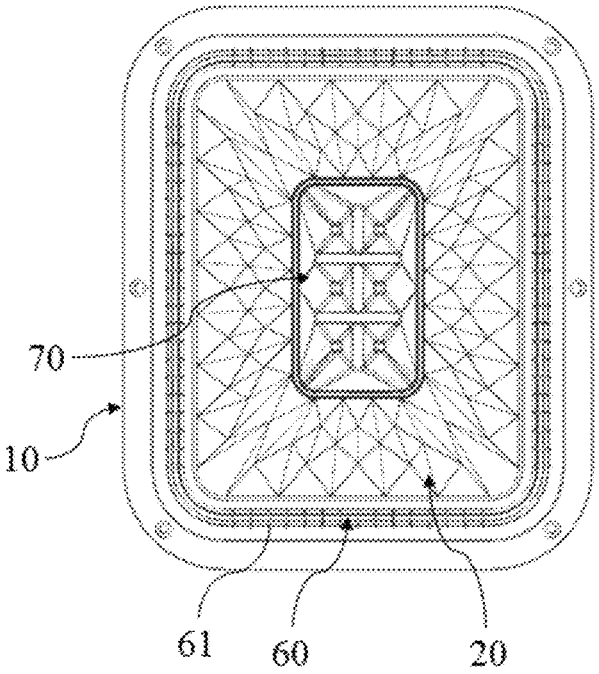
FIG. 5 is a top view of the loudspeaker unit provided by the embodiment of the present disclosure.
Figure 6:
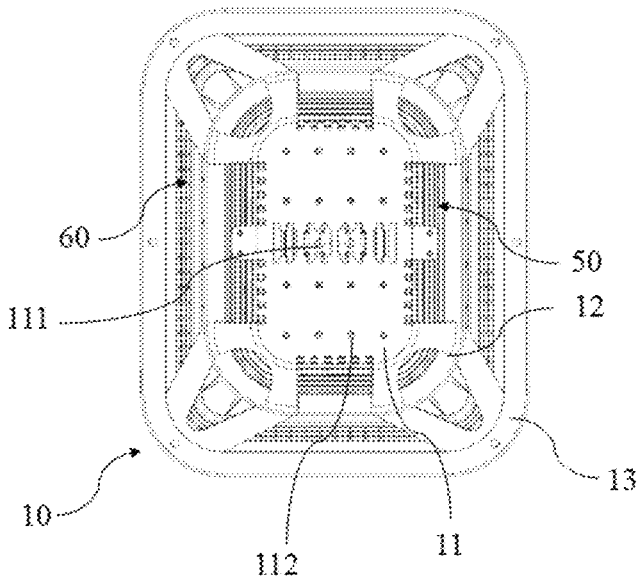
FIG. 6 is a bottom view of the loudspeaker unit provided by the embodiment of the present disclosure.

As shown in FIGS. 3 and 4, the basket 10 is used as a support structure for the suspension system and the magnetic circuit system, and includes a base 11, a first mounting seat 12 and a second mounting seat 13, wherein rounded corners of the base 11 and rounded corners of the first mounting seat 12 are connected by a first support mechanism 14, and the rounded corners of the first mounting seat 12 and rounded corners of the second mounting seat 13 are connected by a second support mechanism 15. The first support mechanism 14 and the second support mechanism 15 both have a parabolic structure, and the thicknesses and angles of legs of the first support mechanism 14 and the second support mechanism 15 change gradually.

The basket 10 is made of hard materials and integrally formed by casting. In a preferred implementation, the use of injection molding materials such as aluminum alloy and polyoxymethylene (POM) can increase the rigidity of the basket 10 and improve the supporting strength and stability of the basket 10. The overall frame structure of the basket 10 can reduce the weight and manufacturing cost.

The first support mechanism 14 can provide greater resistance to distortion and greater stability for the magnetic circuit assembly 40, and the second support mechanism 15 can provide greater resistance to distortion and greater stability for the vibration of the suspension system moving in the axial direction. At the same time, the edges of the first support mechanism 14 and the second support mechanism 15 are curved, which is fashionable and beautiful.

Since the vibration of the suspension system can be propagated to the basket 10 through particle movement to cause resonance of the basket 10, the legs of the first support mechanism 14 and the second support mechanism 15 are configured as a structure with a planar surface but a gradually-changing thickness so that the resonance caused by the natural frequency can be reduced. In addition, the cross sections of the first support mechanism 14 and the second support mechanism 15 are each a plane formed by a hyperbola, and the entire surface is a hyperboloid, which will block the displacement and propagation caused by the particle movement, while also reducing the resonance and improving the sound quality of loudspeaker. In addition, the edges of the basket 10 are in rounded corner transition to minimize the edge line and reduce the resonance caused by the harmonic frequency of the same wavelength as the boundary size.

Ventilation ducts 111 are provided at the center of the bottom of the base 11 of the basket 10. Around the ventilation ducts 111, ventilation holes 112 are also provided, which correspond to the heat dissipation holes of the magnetic cup 41. The ventilation ducts 111 arranged at the center can effectively reduce the direct stress when the membrane 20 vibrates and reduce the force resistance; an air duct formed by the magnetic gap 44, the heat dissipation holes at the bottom of the magnetic cup 41 and the ventilation holes 112 of the basket 10 can enhance the air circulation and improve the ventilation and heat dissipation effect; the base 11 is also provided with heat sinks 113 on the side to enhance heat dissipation.

The membrane bottom 21 is fixed to the first mounting seat 12 of the basket 10 through the spider 50, the membrane edge 23 is of a convex rectangular ring-like structure, and the membrane edge 23 is fixed to the second mounting seat 13 of the basket 10 through the corrugated rim 60. The spider 50 and the corrugated rim 60 can provide compliance $C_{MS}$, restoring force and damping $R_{MS}$ effect for the membrane 20 and the voice coils 31, together with which the suspension system is formed, so that the suspension system maintains linear piston-like movement when the suspension system vibrates.

Figure 12:
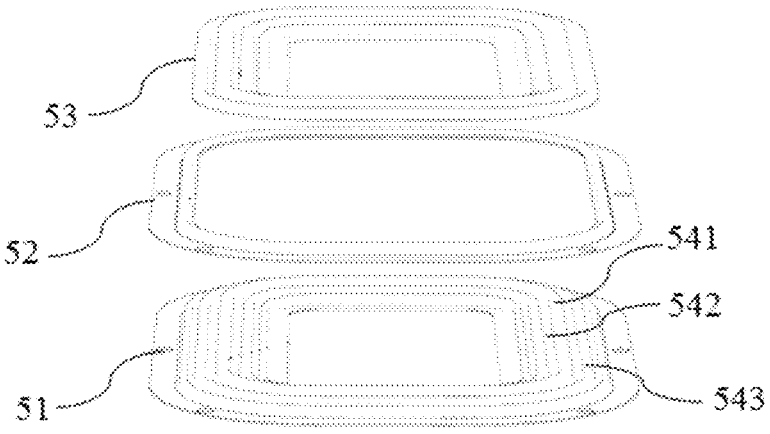
FIG. 12 is a schematic structural view of a spider of the loudspeaker unit provided by the embodiment of the present disclosure.

As shown in FIG. 12, the spider 50 is of a rectangular ring-like structure, including a base layer 51, an outer ring 52 provided on a side of the base layer 51 that is close to the basket 10, and an inner ring 53 provided on a side of the base layer 51 that is close to the voice coils 31. The outer ring 52 is a compliance layer, which can enhance the flexible force of the side connected to the basket 10, make the suspension system easy to vibrate greatly, increase the kinetic energy of the suspension system, and improve the axial compliance, while also enabling the resonant frequency $f_s$ to be effectively reduced. The inner ring 53 is a rigid layer, which can strengthen the rigid force of the side connected to the voice coils 31, reduce the nonlinear deviation of the voice coils 31 and increase the restoring force of the suspension system, thereby increasing the radial rigidity.

The spider 50 is provided with corrugations from the outside to the inside, and the corrugation depth and corrugation width gradually change, i.e., gradually decreasing from the center to the inner and outer sides. For example, as shown in FIG. 12, from a first corrugation 541 to a second corrugation 542 and a third corrugation 543 on both sides respectively, the corrugation depth and width gradually decrease. The use of corrugations with different depths and widths can effectively suppress resonance and stray vibrations, and reduce the resonance of the basket caused by the vibration of the suspension system.

The spider 50 is formed by laminated pressing of a variety of materials, and the base layer 51 is made of fiber cloth, preferably polyimide fiber cloth, so that the spider 50 has advantages such as consistent mechanical stability, good restoring force, strong tear resistance, being less affected by temperature and humidity; the outer ring 52 is made of rubber material to enhance compliance, preferably silicone or styrene-butadiene rubber laminated on the base layer 51 to increase softness and toughness, which can further reduce the resonant frequency $f_s$ and the resonance of the basket caused by the vibration of the suspension system; the inner ring 53 is formed by laminating fiber material on the base layer 51 to enhance the rigidity, preferably polyimide fiber cloth, that is, a layer of polyimide fiber cloth is further laminated on the base layer 51.

In a specific implementation, according to the size requirements of the loudspeaker unit 100, if a stronger restoring force and greater damping $R_{MS}$ are required, a plurality of spiders 50 may be provided, and the plurality of spiders 50 may be stacked together. The adjacent spiders 50 are connected by spacers to ensure that they will not collide with each other during vibration.

Figure 2:
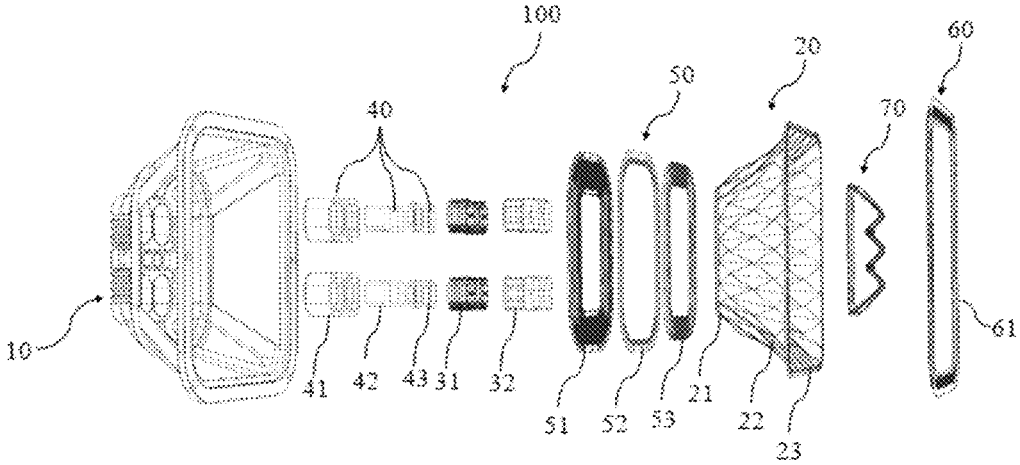
FIG. 2 is a schematic exploded view of a three-dimensional structure of a loudspeaker unit provided by an embodiment of the present disclosure.
Figure 13:
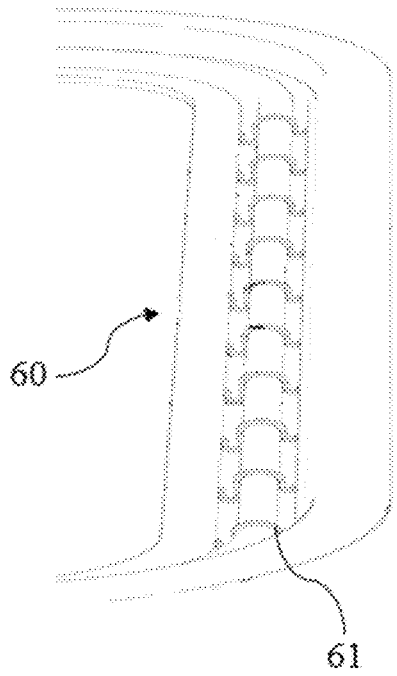
FIG. 13 is a schematic view of a partial structure of a corrugated rim of the loudspeaker unit provided by the embodiment of the present disclosure.
Figure 14:
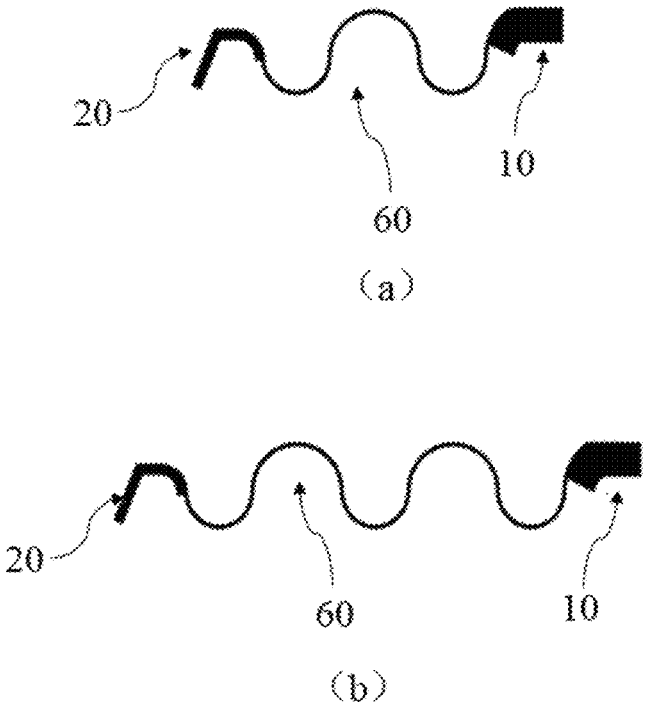
FIGS. 14(*a*)-(*b*) is a schematic cross-sectional view of the structure of the corrugated rim of the loudspeaker unit provided by the embodiment of the present disclosure.

As shown in FIGS. 2, 13 and 14, the corrugated rim 60 is a rectangular rounded-corner corrugated rim, which is fitted and connected with the membrane edge 23. An inner edge of the corrugated rim 60 is bonded to the membrane 20, and an outer edge of the corrugated rim 60 is bonded to the basket 10. The cross-sectional shape of the corrugated rim 60 is a corrugated shape, and the corrugated shape includes multiple peaks and valleys. The shapes (depth and width) of the peaks and valleys are not exactly the same, which can improve the compliance in the axial direction and the rigidity in the radial direction. For example, the corrugated shape may be a one-peak and two-valley shape (FIG. 14*a*) or a two-peak and three-valley shape (FIG. 14*b*), and the depth and width of the peaks and valleys are each not equal to each other so as to suppress the generation of high-order harmonics. The arc of unequalized peaks and valleys suppresses the transmission of some harmonics, wherein the corrugated rim 60 of a one-peak and two-valley shape is suitable for loudspeakers with a small engine stroke, and the corrugated rim 60 with a two-peak and three-valley shape is suitable for loudspeakers with a relatively large engine stroke.

In addition, a plurality of reinforcement ribs 61 are arranged side by side by a certain distance in the direction perpendicular to the cross sections of the peaks and valleys to strengthen the radial rigidity. At the same time, they can effectively suppress resonance and harmonics, reduce air disturbance, and reduce the disturbance to the vibration of the membrane 20 caused by the corrugated rim 60. The reinforcement ribs 61 increase the toughness, fatigue resistance and service life of the corrugated rim 60. In a specific implementation, the reinforcement ribs 61 may be provided either on an upper surface of the corrugated rim 60 or a lower surface of the corrugated rim 60.

In the preferred implementation, the corrugated rim 60 is made of styrene-butadiene rubber formed with styrene and butadiene synthesized. The styrene-butadiene rubber has the characteristics of heat resistance, wear resistance, and aging resistance, and has good compliance and toughness, which can further adjust the proportional relationship between rigidity and compliance of the corrugated rim without affecting the axial movement of the membrane 20.

The present disclosure also provides a loudspeaker device, which includes at least one loudspeaker unit described above.

Since the wavefronts of the sound waves radiated by the rectangular loudspeaker unit 100 in the air belong to cylindrical waves, a pure linear array can be produced, so that the loudspeaker unit 100 of the present disclosure can be directly used to make a real sound column type voice box system and a linear array voice box system. After multiple wavefronts form an array, the intersection area can be weakened, so that multiple loudspeaker units 100 can be naturally coupled without interference, which greatly improves the phase consistency.

Figure 15:
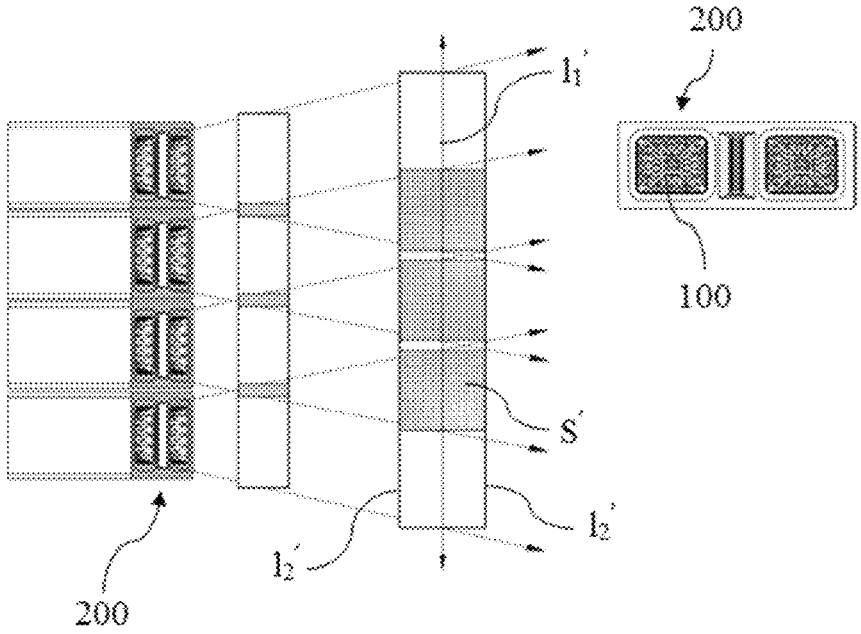
FIG. 15 is a schematic view of a linear array system formed by cylindrical wave loudspeakers provided by an embodiment of the present disclosure.

As shown in FIG. 15, a loudspeaker device 200 includes two loudspeaker units 100, and a plurality of loudspeaker devices 200 are arranged up and down to form a linear array voice box system. The directions of dashed-line arrows in the figure are radiation directions of sound waves. Boundary lines on both sides of an array line $l_1'$ are straight lines $l_2'$ parallel to the array line $l_1'$, that is, the wavefronts are planar. Multiple wavefronts arranged in an array combine to form a sound column with a large wavefront, and the multiple wavefronts arranged in an array can weaken an intersection area S' of adjacent wavefronts so that multiple cylindrical waves are coupled in an orderly manner.

It should be pointed out that in the description of the present disclosure, terms "first" and "second" are only used to distinguish one entity or operation from another entity or operation, and it is not necessarily required or implied that there is any such actual relationship or order between these entities or operations.

It should be pointed out that in the description of the present disclosure, terms "install", "connect", and "couple" should be understood in a broad sense. For example, the connection may be an internal communication of two elements, or a direct connection, or an indirect connection implemented through an intermediate medium, or an electrical connection or signal connection. For those skilled in the art, the specific meaning of the above terms can be understood according to specific conditions.

Described above are only specific embodiments of the present disclosure, but the scope of protection of the present disclosure is not limited to this. Any change or replacement that can be easily conceived by those skilled in the art within the technical scope disclosed in this document should be covered within the scope of protection of the present disclosure. Therefore, the scope of protection of the present disclosure shall be accorded with the scope of the claims.

The invention claimed is:

1. A loudspeaker unit comprising:

a main body comprising a suspension system, a magnetic circuit system having a magnetic gap, and a basket connecting the suspension system with the magnetic circuit system;

wherein the basket accommodates the suspension system and the magnetic circuit system, the magnetic circuit system is fixed in the basket, the suspension system comprises a membrane and at least one voice coil connected to a bottom of the membrane, and the magnetic circuit system comprises at least one magnetic circuit assembly that matches the voice coil, wherein one end of the voice coil is connected to the membrane through a voice coil bobbin, and the other end of the voice coil is suspended in the magnetic gap formed by the magnetic circuit assembly;

wherein the voice coil can vibrate reciprocatively in an axial direction in the magnetic gap to push the membrane to vibrate and emit a sound;

wherein the suspension system further comprises a spider and a corrugated rim, and the membrane comprises a membrane bottom, a membrane body, and a membrane edge that are sequentially connected from the inside to the outside;

wherein the membrane bottom is fixed to the basket through the spider sleeved over the outside of the voice coil bobbin, the membrane edge is connected to an edge of the basket through the corrugated rim, and the membrane bottom is connected to the membrane edge through the membrane body;

wherein the membrane body is configured as a three-dimensional array structure composed of a plurality of irregular-face bodies, the three-dimensional array structure is distributed throughout the surface of the membrane body, and adjacent irregular-face bodies are connected to each other through edges thereof, and wherein the spider is of a rectangular structure and comprises a base layer, a flexible outer ring and a rigid inner ring; the outer ring is arranged on a side of the base layer that is close to the basket, the inner ring is arranged on a side of the base layer that is close to the voice coil, and the base layer, the outer ring and the inner ring are integrally formed by laminated pressing.

2. The loudspeaker unit according to claim 1, wherein the membrane further comprises a membrane base arranged at the membrane bottom, the membrane base is bonded to a back side of the membrane bottom, the membrane is fixedly connected to the basket through the membrane base, and the membrane base is provided with a voice coil connection portion connected with the voice coil bobbin.

3. The loudspeaker unit according to claim 2, wherein the voice coil is wound on the periphery of one end of the voice coil bobbin, and the other end of the voice coil bobbin is connected to the membrane base through the voice coil connection portion.

4. The loudspeaker unit according to claim 3, wherein the voice coil is formed by winding a monolithic body, and the monolithic body comprises a printed flexible circuit board or a single-side insulated metal foil strip.

5. The loudspeaker unit according to claim 3, wherein the voice coil bobbin is made of a high temperature resistant material which comprises a high temperature resistant injection molding material or a lightweight ceramic material, and the voice coil bobbin is of an integral structure.

6. The loudspeaker unit according to claim 1, wherein the irregular-face bodies are triangular-face bodies, and the shapes and sizes of a plurality of the triangular-face bodies are each not exactly the same.

7. The loudspeaker unit according to claim 1, wherein the magnetic circuit assembly comprises a magnetic cup, a magnet, and a magnetic conduction plate, the magnetic cup is installed at a bottom of the basket, the magnet and the magnetic conduction plate are located in the magnetic cup, one end of the magnet is attached to a bottom of the magnetic cup, and the other end of the magnet is attached to the magnetic conduction plate; the magnetic gap is formed between the magnetic cup and the magnet and the magnetic conduction plate, and the voice coil is located in the magnetic gap.

8. The loudspeaker unit according to claim 1, wherein a plurality of the voice coils and a plurality of the magnetic circuit assemblies are provided, the cross-sectional shapes of the voice coils and the magnetic circuit assemblies are both rectangular, and the magnetic gap is a rectangular magnetic gap.

9. The loudspeaker unit according to claim 8, wherein the plurality of voice coils are connected to each other through a circuit, and the circuit comprises a series-connection circuit, a parallel-connection circuit, or a series-parallel comprehensive circuit.

10. The loudspeaker unit according to claim 8, wherein the bottom of the membrane is provided with a circuit board for supplying current to the voice coils, and the plurality of voice coils are respectively connected to the circuit board through lead wires.

11. The loudspeaker unit according to claim 1, wherein the corrugated rim is of a rectangular structure, the cross-sectional shape of the corrugated rim is a corrugated shape, the corrugated shape comprises at least one peak and at least one valley, and the shapes of different peaks and valleys are not exactly the same; the corrugated rim is provided with a plurality of reinforcement ribs for reinforcing the corrugated rim, and the adjacent reinforcement ribs are separated by a certain distance.

12. The loudspeaker unit according to claim 1, wherein the basket is of an integral structure, edges of the basket are in circular arc transition, a side face of the basket is provided with a gradually changing support mechanism, and the bottom of the basket is provided with a ventilation mechanism.

13. A loudspeaker device comprising at least one loudspeaker unit according to claim 1.

14. The loudspeaker device according to claim 13, wherein a plurality of the loudspeaker devices can form a cylindrical-wave linear array voice box system.

* * * * *